US005497380A

United States Patent [19]

Bott et al.

[11] Patent Number: 5,497,380

[45] Date of Patent: Mar. 5, 1996

[54] CONTROL DEVICE FOR THE ACTUATION OF SWITCHGEARS

[75] Inventors: Klaus Bott, Durmersheim; Bernd Schukraft, Karlsruhe, both of Germany

[73] Assignee: Landis & Gyr Technology Innovation AG, Zug, Switzerland

[21] Appl. No.: 355,696

[22] Filed: Dec. 14, 1994

[30] Foreign Application Priority Data

Dec. 24, 1993 [EP] European Pat. Off. ..... 93810910

[51] Int. Cl.[6] ..... G07F 11/00

[52] U.S. Cl. ..... 371/24; 371/48

[58] Field of Search ..... 307/12, 31, 35, 307/39; 371/24, 25.1, 66, 72; 395/750

[56] References Cited

U.S. PATENT DOCUMENTS 4,974,179 11/1990 Patton et al. ..... 364/550
5,086,403 2/1992 Slocum et al. ..... 364/558

FOREIGN PATENT DOCUMENTS 3801952 7/1989 Germany .
3044047 7/1990 Germany .
3041521 8/1990 Germany .
4137204 4/1993 Germany .

*Primary Examiner*—Vincent P. Canney
*Attorney, Agent, or Firm*—Meltzer, Lippe, Goldstein et al.

[57] ABSTRACT

Information appearing in the form of analog low-voltage signals ($V_1$;$V_2$) on call lines (ML1;ML2) which represents the states of switchgears (2.1;2.2) is conveyed in parallel to a circuit block (4). The information is digitalized at certain points in time and in accordance with a predetermined voltage level as binary values "0" or "1" and is transmitted in series to a control logic unit (1). The circuit block (4) is preferably a plurality of shift registers in cascade connection. Each call line is coupled via a coupling element (3.1;3.2) to the circuit block (4) so that the circuit block (4) is not destroyed even when overvoltages occur. In the closed state of a switchgear (2.1;2.2), a signal voltage ($U_1$;$U_2$) with changeable course appears at the corresponding input (4.1;4.2) of the circuit block (4). In the open state of a switchgear (2.1;2.2), the signal voltage ($U_1$; $U_2$) is a uniform signal ($U_1$;$U_2$). The digitalization is effected by means of a synchronization device (8) at points in time when the level of the changeable signal voltage ($U_1$;$U_2$) is clearly different from the level of the zero-point voltage (G). These controls are especially well suited to control an oil or gas burner in continuous operation.

10 Claims, 2 Drawing Sheets

PA 2655

CONTROL DEVICE FOR THE ACTUATION OF SWITCHGEARS

RELATED APPLICATION

The related application entitled "Control Device for the Actuation of Switchgears according to a Time Program" to J. Lelle and filed concurrently herewith is hereby incorporated by reference.

1. Field of the Invention

The invention relates to a control device having a timing and control logic unit for the actuation of several switch gears.

2. Background of the Invention

Such control devices are used, for example, for the control and monitoring of the burner and the igniting device of oil and gas furnaces, as well as to monitor switches of actuators, such as fuel valves and aeration throttles. A microprocessor evaluates the information transmitted over call circuits carrying the mains voltage and issues appropriate control commands. In particular, because of the safety required when switching on and when operating oil and gas furnaces, the switch-off capability of the switchgears for the loads as, for example, a fuel valve which are critical concerning safety regulations must be checked frequently so that a malfunction of the switchgear can be recognized early, before a dangerous situation may develop.

German patents DE-PS 30 44 047 C2 and DE-PS 30 41 521 C2 disclose a switchgear for oil burners in which information on switching states of relay and sensor contacts are transmitted by means of amplifiers to a microprocessor. The switching states of the relay contacts are transmitted via supply voltage carrying call circuits to respective amplifiers which are connected at the output to an input of the microprocessor. The microprocessor must be provided with a number of inputs at least equal to the number of amplifiers. For the galvanic separation of the call circuit and the microprocessor, separative elements, such as optocouplers or transmitters, are used. Here one separative element per signal voltage is present. The microprocessor is programmed to carry out a number of tests in order to ascertain whether the system having connected sinks actually and correctly goes through a switching-on phase. For this purpose, signals are memorized by the microprocessor and are compared with desired values. In the case of a defective sink state, the microprocessor switches off the sinks.

Furthermore, in an arrangement for the monitoring of alternative-current switches known from DE-OS 41 37 204, call circuits carrying mains voltage are connected via optocouplers to the scanning unit of an alternative-current detector. Each call circuit is connected to the optocoupler via a low pass consisting of a resistance and a capacitor connected in series to the optocoupler. The switching states of the A.C. switches are scanned and stored via the call circuits. In an evaluation unit downstream of the scanning unit, the switching states are compared with a desired state (open or closed) and a switching state signal containing at least one information item (error or no error) for all the existing A.C. switches is formed. It is not possible to know, from the switching state signal, which A.C. switch can no longer be switched off. Therefore, a simple display for diagnosis is not possible.

Optocouplers have been used, for example, as separative elements for the galvanic separation of the monitored system from the microprocessor. Optocoupler applications of this type are known from the specialized literature (TI Opto Kochbuch of 1975, ISBN 3 88078 000 5).

However, the optocouplers are disadvantageous because they are not error-proof and have a higher failure rate than other electronic components. Therefore, they must be checked for false signals also in active operation when used in applications where safety is critical. Furthermore, as the number of optocouplers increases, the electromagnetic compatibility and, thereby, the reliability of the control unit decrease. In systems with many call circuits carrying mains voltage this could involve great costs for as long as an expensive separative element, such as an optocoupler or transmitter and an input pin on the microprocessor, must be provided for each call circuit.

SUMMARY OF THE INVENTION

It is an object of the present invention to design a control device with a control logic unit in such a manner that it easily and reliably acquires information on the state of switchgears switching loads on or off ,where the information is available in the form of low-voltage signals, and transmits it to the control logic unit.

In one embodiment of the invention a control device for controlling a system a burner, for example, is provided. The control device comprises a timing and control logic unit and a plurality of switchgears which are actuated by the timing and control logic unit. A plurality of loads are provided. Each of the plurality of loads is connected in series to one of the plurality of switchgears in a mains voltage network of low tension between a phase and a zero-point. The loads receive current supply from the switchgears. A plurality of call circuits is provided. Each of the plurality of call circuits has an input connected to the series connections of one of the loads and one of the switchgears. A circuit block has a plurality of parallel inputs. Each parallel input is connected to one of the call circuits. The circuit block detects the state of each of the switchgears. The circuit block has a serial data output which is electrically connected to an input of the control logic unit via a serial data line. Each of the call circuits comprises a coupling element having an input connected on the series connection of a load and a switchgear and an output connected to the circuit block. Voltage signals are transmitted from the coupling elements to the circuit block. The voltages have a level of the zero-point when one of the plurality of switchgears is in an open state. The voltages are A.C. or D.C. voltages when one of the plurality of switchgears is in a closed state. The voltages are dependent on a timely voltage course of the phase relative to the zero-point.

The control logic unit causes the detection of the states of the switchgears by the circuit block by carrying out a test cycle. During the test cycle, the voltage signals are detected at the inputs of the circuit block as binary numbers as a function of a predetermined voltage level. Each binary number represents one state of said switchgears. The voltage signals are transmitted via the serial output and the serial data line to the control logic unit.

In another embodiment, the circuit block comprises at least one shift register connected in cascade.

In yet another embodiment, a synchronization device which synchronizes the detection of the voltages at the inputs of the circuit block with the mains voltage is provided.

In yet another embodiment, the detection of the state of the switchgears is made on the basis of state values obtained during a period of one to two half-waves of the mains voltage by multiple scanning.

In still another embodiment, separative elements which galvanically separate the circuit block and the control logic unit are provided.

In another embodiment, the testing cycle is carried out at given points in time to detect the state of the switchgears so as to recognize errors in continuous operation of the system.

In another embodiment, a testing module having one serial data input and a plurality of parallel outputs is provided. The testing module is connected to said control logic unit. The parallel outputs are connected to the inputs of the circuit block. The parallel outputs can be switched into either a conductive or a high-impedance tristate state. The testing module can comprise at least one shift register connected in cascade.

In yet another embodiment, the control device carries out a test cycle to detect input coupling errors or hardware errors of the circuit block at predetermined points in time by entering a test pattern via a serial data line into the testing module, putting the testing module in the conductive state, causing the voltage levels appearing at the inputs of the circuit block to be detected and transmitted to the control logic unit, comparing the returned test pattern with the entered test pattern and putting the testing module back into the tristate state. The test pattern comprises binary values.

BRIEF DESCRIPTION OF THE DRAWINGS

An example of the invention is explained in further detail through the drawings.

DETAILED DESCRIPTION OF THE INVENTION

Figure 1:
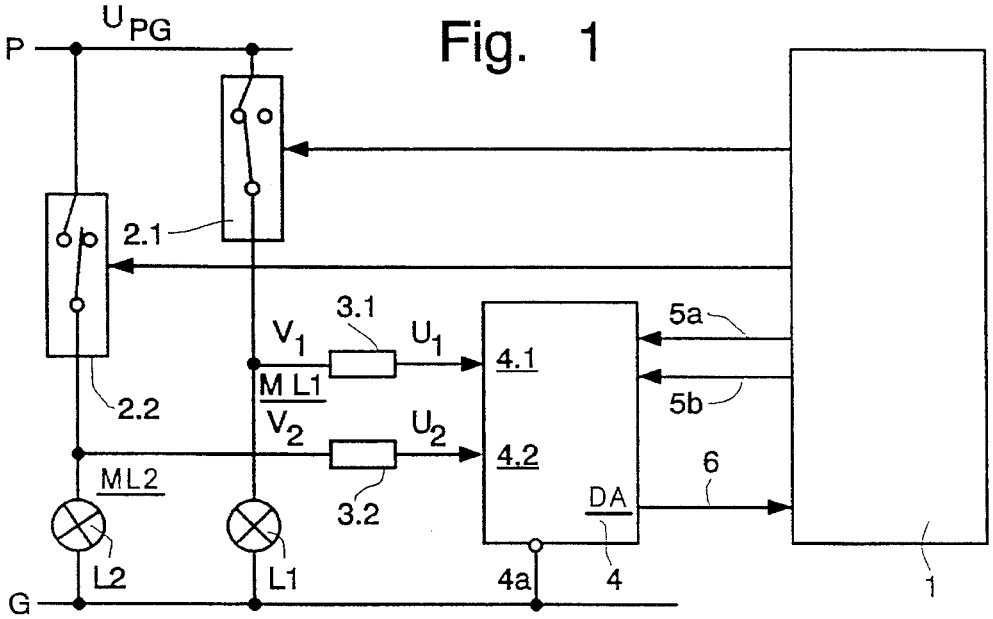
FIG. 1 shows a control device for the actuation of several switchgears.

FIG. 1 shows a control device for a burner having a timer and control logic unit 1 in the form of a microprocessor. The control device comprises two switchgears 2.1 and 2.2, two coupling elements 3.1 and 3.2 and one circuit block 4. The output of the first switchgear 2.1, which switches a load L1 to a mains voltage $U_{PG}$ located between a phase P and a zero point G, is connected to the input of the first coupling element 3.1. The output of the second switchgear 2.2, by means of which an additional load L2 is supplied by the mains voltage $U_{PG}$, is connected to the input of the second coupling element 3.2. The outputs of the coupling elements 3.1 and 3.2 are connected to parallel inputs 4.1 and 4.2 of the circuit block 4, so that the low-voltage signals $V_1$ or $V_2$ which appear at the taps between the switchgears 2.1 or 2.2 and the loads L1 or L2 are transmitted to the circuit block 4 for further processing via the coupling elements 3.1 or 3.2 representing a call circuit ML1 or ML2. The circuit block 4 is electrically connected to the zero-point G via a line **4*a*. Additionally, the circuit block 4 is connected via two control lines 5*a* and 5*b*, as well as a serial output DA and a serial data line 6, to the microprocessor 1 for transmission of the voltage levels $U_1$ or $U_2$ present at the inputs 4.1 and 4.2 to the microprocessor 1. The control device can also be designed to control more than two loads, e.g., n=32 loads. Additional loads may also be controlled by the microprocessor 1 without monitoring of the state of the appertaining switchgear and, therefore, they are not connected to the circuit block 4 as the described loads L1 and L2**.

The microprocessor 1 is programmed by a time program to switch the loads L1 and L2 on and off in a given sequence by means of the switchgears 2.1 and 2.2 during the switch-on phase of a gas burner, for example, and to monitor different processes, such as the formation of a flame and to switch off the entire system if necessary, so that the gas burner is at no time in danger of exploding. In addition, in continuous operation of the system to be controlled the microprocessor 1 executes a monitoring program for the recognition of error states. In order to determine the state (opened or closed) of the switchgears 2.1 or 2.2, the microprocessor 1 executes a testing cycle, as explained below. The frequency of the testing cycles depends on the application of the control device and the applicable legal provisions or standards. Thus for instance, automatic furnaces which meet the requirements of Standard EN 298 must recognize an error within a period of three seconds following its occurrence. A testing cycle is, therefore, executed typically every 200 milliseconds. In this manner, it is possible to reliably ascertain the state of each of the switchgears 2.1 or 2.2 within the required three seconds also if the state of one of the switchgears 2.1 or 2.2 has just changed during a testing cycle.

In the closed state of switchgear 2.1, as shown in FIG. 1, a current flows through this switchgear 2.1 and the appertaining load L1. Therefore, at the input of the coupling element 3.1, an A.C. voltage appears in the form of a low-tension signal $V_1$ which is substantially equal to the mains voltage $U_{PG}$. In the open state of the switchgear 2.2, as shown in FIG. 1, a low-tension signal $V_2$ in the form of a D.C. voltage corresponding to the zero point G appears at the input of the coupling element 3.2. The coupling elements 3.1 and 3.2 serve in a known manner for the rectification of the low-voltage signals $V_1$ and $V_2$ and for the limitation of their level to the processable input levels of the circuit block 4. The coupling elements 3.1 and 3.2 also drain off overvoltages to the zero-point voltage G in order to prevent destruction of the circuit block 4 by voltage or current impulses. To this purpose the coupling elements are connected to the zero-point circuit G in a manner not shown here. A signal voltage $U_1$ thus appears at the input 4.1, its form and/or level being clearly different from the D.C. voltage $U_2$ with zero-point level G appearing at the input 4.2.

The testing cycle for the determination of the state of the switchgears 2.1 or 2.2 is as follows: at a suitable moment the microprocessor 1 causes the signal voltages $U_1$ and $U_2$ at the inputs 4.1 and 4.2 of the circuit block 4 to be detected according to a predetermined voltage level in the form of binary numbers "0" or "1" in parallel and to be transmitted thereupon to itself via the serial output DA of the circuit block 4 and the serial data line 6. A number "0" represents an open state and a number "1" a closed state.

The described control device makes it possible to use a control logic unit 1, particularly a microprocessor, with a number of inputs which may be substantially lower than the number m of the loads L1 to Lm whose appertaining switchgears 2.1 to 2.m must be monitored for their contact positions. In a control device or unit where the control logic unit 1 must be galvanically separated from the mains voltage $U_{PG}$ for reasons of safety, additional advantages with respect to reliability, electromagnetic compatibility and costs are achieved. These advantages are due to the fact that the control logic unit 1 can be separated from the circuit block 4, and thereby, also from the mains voltage $U_{PG}$ with only few galvanic separative elements. Therefore, the number of galvanic separative elements can also be considerably lower than the number m. A malfunction of one of the switchgears 2.1 or 2.2 is easy to indicate, since the information on the state of each of the switchgears 2.1 or 2.2 is available in the control logic unit 1 and can be displayed by simple means, e.g., luminous diodes or an LCD display.

Such a device can also be used as a signalling device to scan the position of switching contacts and to display them in process equipment.

Instead of the microprocessor 1, it is also possible to use a microcontroller, an application-specific integrated circuit (ASIC) or a programmable area logic (PAL). The control devices are suitable for operation in a D.C., as well as in an A.C. network, whereby the mains voltage $U_{PG}$ may also be in the range of low voltages, with a typical value of 24 V.

Figure 2:
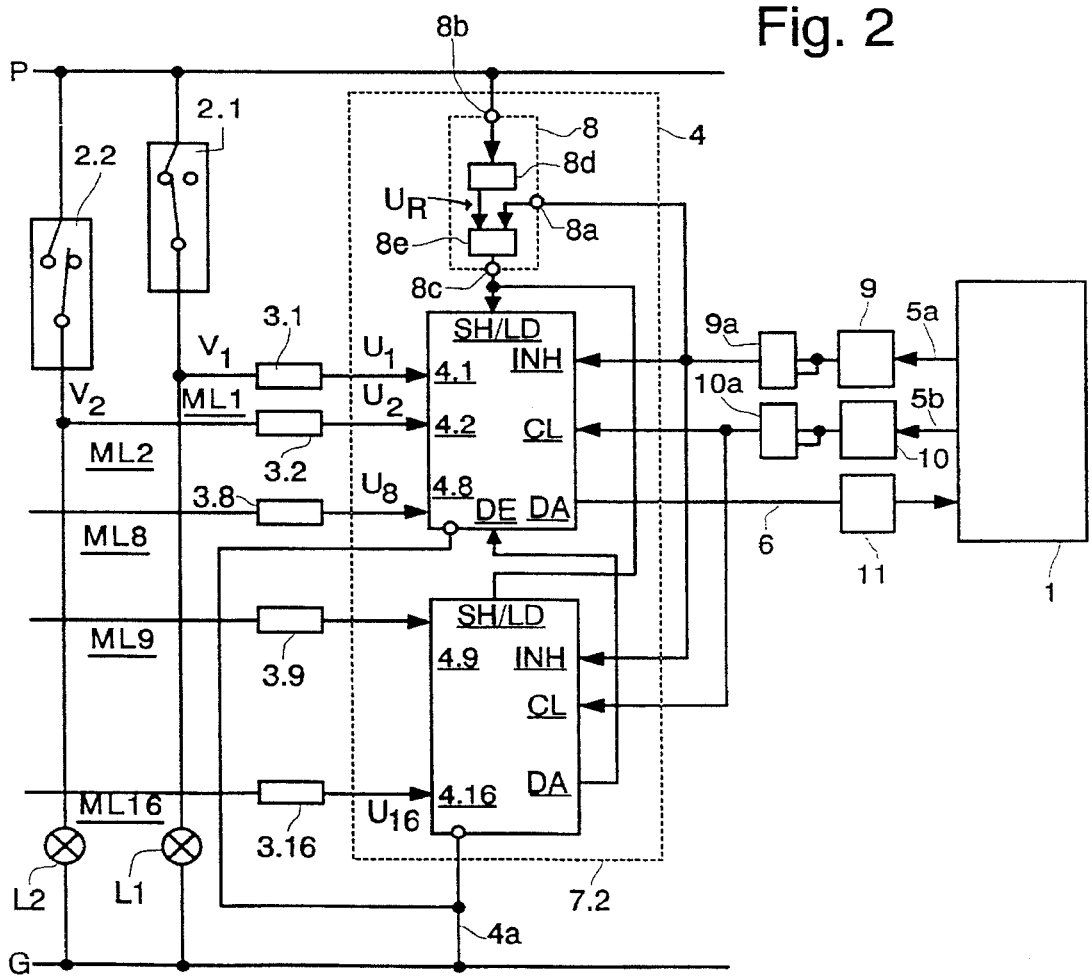
FIG. 2 shows a control device with shift registers and a synchronization device.
Figure 3:
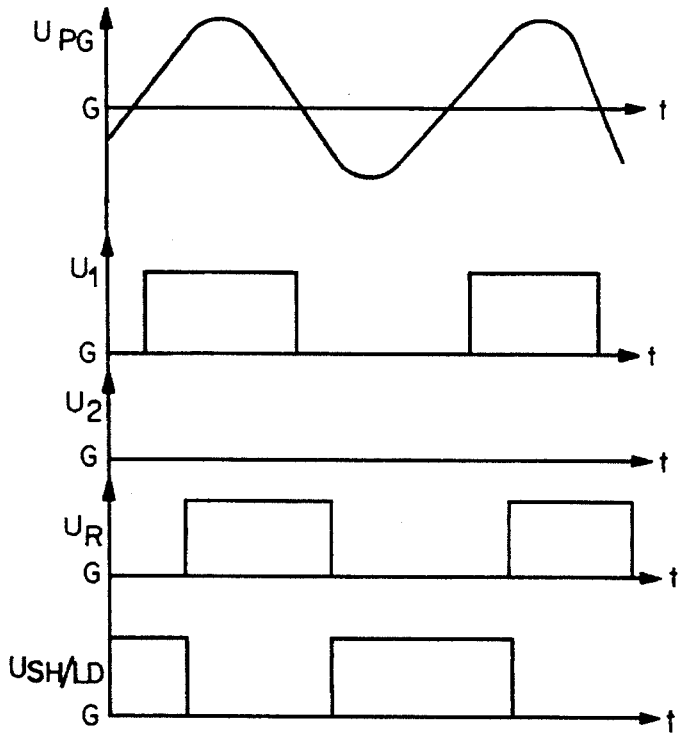
FIG. 3 shows voltage diagrams.

For the operation of the control unit in a D.C. network, synchronization for data collection is not required, while it is necessary for operation in an A.C. network. FIG. 2 shows a control device for operation in an A.C. network having n=16 switchgears, 2.1 to 2.16. FIG. 3 illustrates the time diagrams of the voltages $U_{PG}$, $U_1$, $U_2$, $U_R$ and $U_{SH/LD}$, as explained below. The control device is equipped with a circuit block 4 consisting of two shift registers 7.1 and 7.2 and of a synchronization device 8. For the sake of clarity, only the switchgears 2.1 and 2.2 and the coupling elements 3.1, 3.2, 3.8, 3.9 and 3.16 are drawn. The shift registers 7.1 and 7.2 have eight parallel inputs 4.1 to 4.8 or 4.9 to 4.16 as well as a serial data input DE and a serial data output DA. In the control lines 5*a* and 5*b*, as well as in the data line 6, optocouplers 9, 10 or 11 are installed and are used for galvanic voltage separation between the microprocessor 1 and the circuit block 4 under mains voltage. The optocouplers 9 and 10 are followed by a NAND element 9*a* or 10*a* for level reversal.

The modules MM74HC165 of National Semiconductor can be used as shift registers 7.1 and 7.2. They are provided with a clock input CL, a clock inhibit input INH and a shift/load input SH/LD for data collection and data output. Their operation is described in "MM47HC/47HC High-Speed CMOS Family Databooklet, National Semiconductor Corporation, 1981".

The synchronization device 8 has two inputs 8*a* and 8*b* and one output 8*c*. The input 8*a* is connected to the output of the NAND element 9*a* and to the control input INH of the shift registers 7.1 and 7.2. The mains voltage $U_{PG}$ appears at the input 8*b*. The output 8*c* is connected to the input SH/LD of the two shift registers 7.1 and 7.2. The serial output DA of the second shift register 7.2 is connected to the serial input DE of the first shift register 7.1, so that a cascade connection is created.

The switchgear 2.1 is in a closed state so that a sinusold alternative voltage appears at the input of the coupling element 3.1 in the form of a low-voltage signal $V_1$. The coupling links 3.1 to 3.16 are known as a network of resistances, capacitors, diodes and a Z-diode, arranged so that a single-way rectified rectangular voltage $U_1$ appears at the output of the coupling element 3.1, with a level of a few volts, e.g., 5.7 V, relative to the zero point G.

The switchgear 2.2 is in the open state so that the low-voltage signal $V_2$ at the input of the coupling element 3.2 has the form of a D.C. voltage which appears at the output of the coupling element 3.2 as D.C. voltage $U_2$ with the zero-point level G.

The synchronization device 8 is provided with a coupling element 8*d* behind its input 8*b*, built up similarly to the coupling elements 3.1 to 3.16. A pulsating rectangular voltage $U_R$ appears at the output of the coupling element 8*d*. The phase of the rectangular voltage $U_R$ is synchronized with the rectangular voltage $U_1$ at the input 4.1 of the shift register 7.1. The output of the coupling element 8*d* is connected to the one input of a NAND element 8*e* and the control line 5*a* via input 8*a* to the other input of the NAND element 8*e*. The outputs of the NAND elements 9*a*, 10*a* and 8*e* are advantageously equipped with Schmitt-Trigger steps in order to obtain well-defined switching.

In normal operation of the control unit, the control lines 5*a* and 5*b* at the output of the microprocessor 1 are on low potential, so that the optocouplers 9 or 10 are in a dimmed state, while the control lines 5*a* and 5*b*, after the NAND elements 9*a* or 10*a*, carry a high potential because of the level reversal. Thus, a logically high state exists at the input INH while a pulsating rectangular voltage $U_{SH/LD}$, which is complementary of the rectangular voltage $U_R$, appears at the input SH/LD. Whenever the rectangular voltage $U_{SH/LD}$ changes from high to low potential, the voltage levels $U_1$ to $U_{16}$, which are present at the inputs 4.1 to 4.16 of the shift registers 7.1 and 7.2, are detected as logic state value "0" or "1" and are stored in the registers. The phase of the rectangular voltage $U_{SH/LD}$ relative to the rectangular voltage $U_1$ is coordinated by means of the coupling element 8*d* so that the change-over of the rectangular voltage $U_{SH/LD}$ from high to low occurs whenever the voltage $U_1$ is already high, and a value "1" representing a logically high potential is memorized as state value of the switchgear 2.1 which is in the closed state. Since the switchgear 2.2 is open, the voltage $U_2$ is recognized according to a logically low potential as state value "0". In this manner, the parallel loading of the shift registers 7.1 and 7.2 always takes place at a point in time when a voltage level of a few volts appears at the inputs 4.1 to 4.16 in the closed state of a switchgear or a voltage level of zero volt relative to the zero-point level G in the open state of a switchgear. The constant data acquisition offers the advantage that the current states of the switchgears 2.1 to 2.16 are always available in the shift registers 7.1 and 7.2. To read the state values from the shift registers 7.1 and 7.2, the microprocessor 1 sets the control line 5*a* on high potential whereby a high potential also appears at the SH/LD inputs. In this manner, the data acquisition of the shift registers 7.1 and 7.2 is locked. With every shift impulse transmitted thereafter by the microprocessor 1 via the control line 5*b*, the detected state values are shifted by one place in the direction to the output DA of the shift registers 7.1 and 7.2. A value appearing at the output DA of the second shift register 7.2 is thus transmitted via the connection line to the serial input DE of the first shift register 7.1. A value appearing at the output DA of the first shift register 7.1 is transmitted over the serial data line 6 and the optocoupler 11 to the microprocessor 1. Following the first shift command the state value of the switchgear 2.1 thus arrives at the input of the microprocessor 1. Following the second shift command, it is the state value of switchgear 2.2, etc., until the state value of switchgear 2.16 arrives after the 16th shift command. The testing cycle to be carried out by the microprocessor 1 in order to detect the state of the switchgears 2.1 to 2.16 thus consists of the control commands required to lock the data acquisition and to read the shift registers 7.1 and 7.2.

The circuit arrangement with the shift registers 7.1 and 7.2 is advantageous because commercially available standard elements are used by means of which the control device can easily be expanded for any number of switchgears just by cascading. The utilization of the synchronization device 8 makes it possible to lay out the coupling elements 3.1 to 3.16, which only need to deliver a single-way rectified rectangular voltage at their output, in a simple manner. The memory requirements for the programming of the testing cycle are low because the testing cycle mainly comprises shift commands.

The synchronization device 8 is a hardware device used to ascertain that the state information of the switchgears 2.1 to 2.16, which is contained in the signal voltages $U_1$ to $U_{16}$, is correctly acquired. This information could also be obtained by means of software, through multiple interrogation within a time period of one to two network half-waves, and an analysis of the values acquired in the time sequence, so that a synchronization device 8 would not be needed. Such examples of embodiments are described in the patent application "Controls for the Actuation of Switchgears according to a Time Program" by the inventor Josef Lelle which is subject to a parallel submission to the European Patent Office and filed concurrently herewith in the United States Patent Office. The text of which is an integral part of the instant application and is hereby incorporated by reference.

Figure 4:
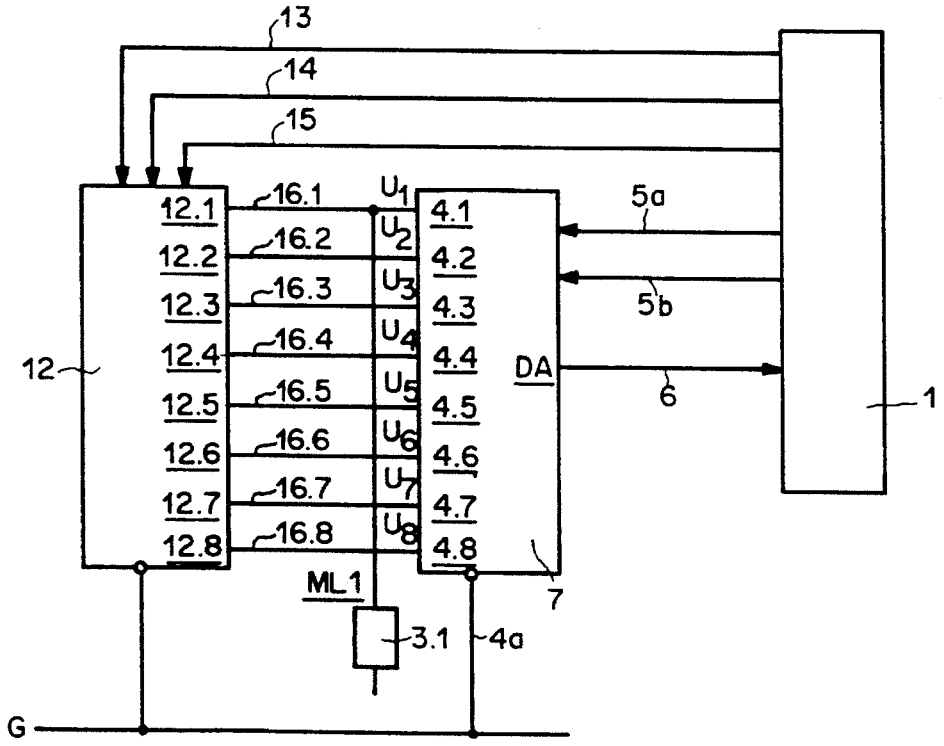
FIG. 4 shows a control device with a testing module.

FIG. 4 illustrates a further development of a device for the control of up to n=8 switchgears 2.1 to 2.8 which are expanded by one testing module 12 to detect input coupling errors or hardware errors of the shift register 7. An input coupling error may occur, for example, if the state value read into the input 4.2 not only depends on the voltage level at input 4.2 but also on the voltage level which is present at another input, e.g., 4.5. A hardware error occurs when the read state value of an input always appears as logic "0" (stack at zero) or logic "1" (stack at one), whatever the appearing voltage level may be.

The testing module 12 is provided with a serial data input, a cycle input and an input which controls the state of its outputs 12.1 to 12.8. All of these inputs are connected via circuits 13, 14 or 15 to the microprocessor 1. Parallel outputs 12.1 to 12.8 are connected via circuits 16.1 to 16.8 to the corresponding inputs 4.1 to 4.8 of the shift register 7. The outputs 12.1 to 12.8 can be switched to a state which is known in the field as "tristate", in which they are high-impedance outputs and do not influence the state of the circuits 16.1 to 16.8 (see, e.g., U. Tietze and Ch. Schenk, "Semiconductor Switching Technology" (Halbleiterschaltungstechnik), 5th edition, Springer Verlag Berlin Heidelberg New York, ISBN 3-540-09848-8). The inputs 4.1 to 4.8 of the shift register 7 are also connected to the outputs of the coupling elements 3.1 to 3.8, but only the coupling element 3.1 is drawn for the sake of clarity. The testing module 12 as well as the shift register 7 are connected to the zero-point line G.

The control device illustrated in FIG. 4 functions as follows.

In normal operation the outputs 12.1 to 12.8 of the testing module 12 are in the tristate state and do not influence the voltages $U_1$ to $U_8$ at the inputs 4.1 to 4.8. To test the reliability of data acquisition by means of the circuit block 4 the microprocessor 1 carries out a test cycle at given points in time. During the test cycle, the microprocessor 1 transmits a test pattern consisting of eight binary values "0" or "1" via the serial circuit line 13 to the testing module 12. Following this transmission, these values are available as high or low voltages at the outputs 12.1 to 12.8 as soon as the microprocessor 1 puts the outputs 12.1 to 12.8, in a conductive state via control circuit line 15, so that voltage levels $U_1$ to $U_8$ with high or low voltage values, depending on the previously transmitted test pattern, appear at the inputs 4.1 to 4.8 of the shift register 7. The microprocessor 1 now transmits further commands to the shift register 7 in order to detect the voltage levels $U_1$ to $U_8$ at its inputs 4.1 to 4.8 as binary values and for their transmission to it. The microprocessor 1 then compares the reported binary values with the transmitted test pattern. The microprocessor 1 is programmed to transmit a number of selected test patterns to the testing module 12 and to read them again via shift register 7, so that input coupling errors, as well as hardware errors, can be detected. If necessary the control circuit lines 13, 14 and 15 can be provided with galvanic separative elements.

Finally, the above-described embodiments of the present invention are intended to be illustrative only. Numerous alternative embodiments may be devised by those skilled in the art without departing from the spirit and scope of the following claims.

We claim:

1. A control device for controlling a system comprising, a timing and control logic unit, a plurality of switchgears which are actuated by said timing and control logic unit, a plurality of loads, each of said plurality of loads being connected in series to one of said plurality of switchgears in a low-voltage network between a phase and a zero-point, wherein said loads receive current supply from said switchgears, a plurality of call circuits, each of said plurality of call circuits having an input connected to one of said loads and one of said switchgears, a circuit block having a plurality of parallel inputs, each parallel input being connected to one of said call circuits, so that said circuit block detects a state of each of said switchgears, and having a serial data output and a serial data line connected to said serial data output and an input of said control logic unit, wherein each of said call circuits comprises a coupling element having an input connected on the series connection of a load and a switchgear and an output connected to said circuit block, and voltage signals are transmitted from said coupling elements to said circuit block, said voltages having a level of said zero-point when one of said plurality of switchgears is in an open state and said voltages are A.C. or D.C. voltages when one of said plurality of switchgears is in a closed state, said voltages being dependent on a timely voltage course of said phase relative to said zero-point, and wherein said control logic unit causes said detection by said circuit block of said states of said switchgears by carrying out a testing cycle during which testing cycle said voltage signals are detected at said inputs of said circuit block as binary numbers as a function of a predetermined voltage level, each binary number representing one state of said switchgears, and are transmitted via said serial output and said serial data line to said control logic unit.

2. The control device of claim 1, wherein said circuit block comprises at least one shift register connected in cascade.

3. The control device of claim 1, further comprising a synchronization device which synchronizes the detection of the voltages ($U_1$ to $U_{16}$) at said inputs of said circuit block with a mains voltage ($U_{PG}$).

4. The control device of claim 1, wherein said detection of the state of the switchgears is made on basis of state values obtained during a period of one to two network half-waves by multiple scanning.

5. The control device of claim 1, further comprising separative elements which galvanically separate said circuit block and said control logic unit.

6. The control device of claim 1, wherein said testing cycle is carried out at given points in time to detect the state of the switchgears, so as to recognize errors in continuous operation of said system.

7. The control device of claim 1, further comprising a testing module having one serial data input and a plurality of parallel outputs and being connected to said control logic unit, wherein said parallel outputs are connected to said inputs of said circuit block and said parallel outputs can be switched into either a conductive or a high-impedance tristate state.

8. The control device of claim 7, wherein said testing module comprises at least one shift register connected in cascade.

9. The control device of claim 7, wherein said control logic unit carries out a test cycle to detect input coupling errors or hardware errors of said circuit block at predetermined points in time by entering a test pattern comprising binary values via a serial line into said testing module, putting said testing module in the conductive state, causing the voltage levels appearing at said inputs of said circuit block to be detected and transmitted to said control logic unit, comparing the returned test pattern with the entered test pattern and putting the testing module back into the tristate state.

10. The control device of claim 1, wherein said control logic unit comprises a microprocessor.

* * * * *